US008867706B2

(12) United States Patent
Treseder et al.

(10) Patent No.: US 8,867,706 B2
(45) Date of Patent: Oct. 21, 2014

(54) ASYMMETRIC X-RAY TUBE

(75) Inventors: Robert Clark Treseder, North Salt Lake, UT (US); James E. Burke, Glenview, IL (US)

(73) Assignee: Varian Medical Systems, Inc., Palo Alto, CA (US)

( * ) Notice: Subject to any disclaimer, the term of this patent is extended or adjusted under 35 U.S.C. 154(b) by 882 days.

(21) Appl. No.: 12/942,077

(22) Filed: Nov. 9, 2010

(65) Prior Publication Data

US 2012/0114104 A1 May 10, 2012

(51) Int. Cl.
*H01J 35/06* (2006.01)
*H01J 35/26* (2006.01)

(52) U.S. Cl.
CPC *H01J 35/06* (2013.01); *H01J 35/26* (2013.01)
USPC ..... 378/136; 378/121; 378/125

(58) Field of Classification Search
USPC ..... 378/121, 125, 136, 144, 161
See application file for complete search history.

(56) References Cited

U.S. PATENT DOCUMENTS

| | | | | |
|---|---|---|---|---|
| 6,005,918 | A * | 12/1999 | Harris et al. | 378/140 |
| 6,400,799 | B1 * | 6/2002 | Andrews | 378/141 |
| 6,438,207 | B1 * | 8/2002 | Chidester et al. | 378/138 |
| 6,519,318 | B1 * | 2/2003 | Andrews | 378/141 |
| 6,570,959 | B1 * | 5/2003 | Kuzniar | 378/123 |
| 7,209,544 | B2 * | 4/2007 | Xu et al. | 378/136 |
| 8,284,899 | B2 * | 10/2012 | Virshup | 378/136 |
| 2009/0129549 | A1 | 5/2009 | Virshup | |

* cited by examiner

*Primary Examiner* — Allen C. Ho
(74) *Attorney, Agent, or Firm* — Maschoff Brennan

(57) ABSTRACT

An asymmetric x-ray tube. In one example embodiment, an x-ray tube includes an evacuated enclosure, a cathode assembly at least partially positioned within the evacuated enclosure and defining a first axis, and an anode assembly at least partially positioned within the evacuated enclosure and defining a second axis. The anode assembly includes a rotating anode having a focal spot. The focal spot and the second axis define a plane. The first axis is positioned beneath the plane.

14 Claims, 5 Drawing Sheets

ASYMMETRIC X-RAY TUBE

BACKGROUND

X-ray tubes are extremely valuable tools that are used in a wide variety of applications, both industrial and medical. An x-ray tube typically includes a cathode and an anode positioned within an evacuated enclosure. The cathode includes an electron source and the anode includes a target surface that is oriented to receive electrons emitted by the electron source. During operation of the x-ray tube, an electric current is applied to the electron source, which causes electrons to be produced by thermionic emission. The electrons are then accelerated toward the target surface of the anode by applying a high-voltage potential between the cathode and the anode. When the electrons strike the anode target surface, the kinetic energy of the electrons causes the production of x-rays. The x-rays ultimately exit the x-ray tube through a window in the x-ray tube, and interact with a material sample, patient, or other object.

The dimensions of a rotating anode x-ray tube are often constrained by the dimensions of the x-ray system into which the x-ray tube is to be integrated. In addition, the dimension of the x-ray tube can also be constrained by various x-ray system components that are configured to direct, alter, or otherwise interact with the x-rays produced by the x-ray tube. Other dimensions of the x-ray tube, such as the distances between target track and the window, may also be constrained by the corresponding x-ray system.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to an asymmetric x-ray tube. Among other things, example embodiments of the asymmetric x-ray tube disclosed herein enable the focal spot of the rotating anode to be positioned closer to the window of the x-ray tube than in typical symmetrical x-ray tubes in which the cathode assembly is symmetrical with the anode assembly. The example asymmetric x-ray tube disclosed herein is also generally more compact and thus can be positioned in a smaller space than typical symmetrical x-ray tubes.

In one example embodiment, an x-ray tube includes an evacuated enclosure, a cathode assembly at least partially positioned within the evacuated enclosure and defining a first axis, and an anode assembly at least partially positioned within the evacuated enclosure and defining a second axis. The anode assembly includes a rotating anode having a focal spot. The focal spot and the second axis define a plane. The first axis is positioned beneath the plane.

In another example embodiment, an x-ray tube includes an evacuated enclosure having a first end, a cathode assembly at least partially positioned within the evacuated enclosure and defining a first axis, an anode assembly at least partially positioned within the evacuated enclosure and defining a second axis. The anode assembly includes a rotating anode having a focal spot on a first surface and having a second surface opposite the first surface. The anode assembly is at least partially surrounded by a stator. The focal spot and the second axis define a plane. The first axis is positioned beneath the plane. The first surface faces toward the stator and the second surface faces toward the first end of the evacuated enclosure.

In yet another example embodiment, an x-ray tube includes an evacuated enclosure, a cathode assembly at least partially positioned within the evacuated enclosure and defining a first axis, and an anode assembly at least partially positioned within the evacuated enclosure and defining a second axis. A cathode extends from the cathode assembly such that the cathode is not intersected by the first axis. The anode assembly includes a rotating anode having a focal spot. The anode assembly is at least partially surrounded by a stator. The focal spot and the second axis defining a plane. The first axis is positioned beneath the plane. The focal spot faces toward the stator These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to an asymmetrical x-ray tube. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example X-Ray Tube

Figure 1A:
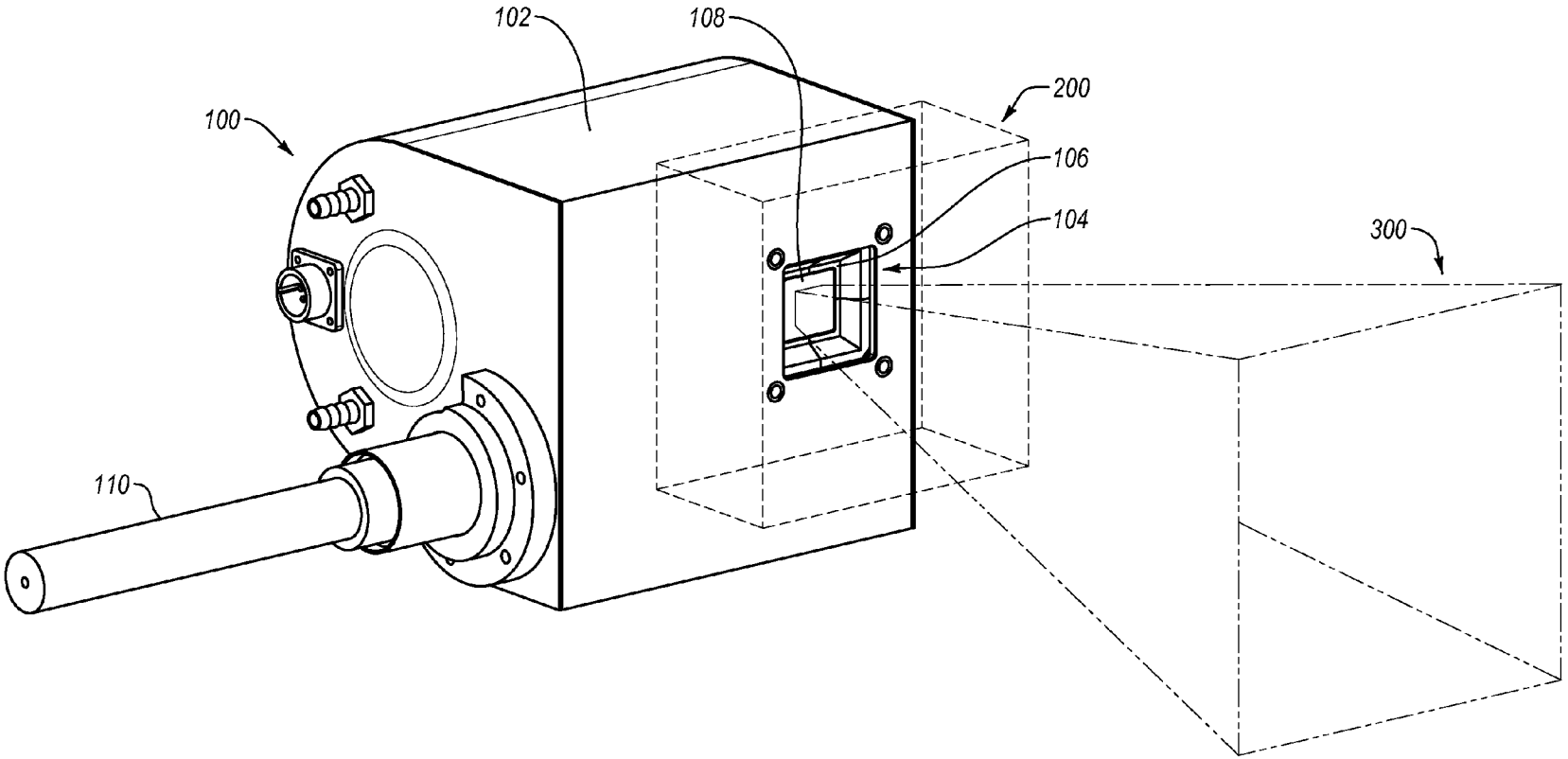
FIG. 1A is a perspective view of an example x-ray tube, collimator, and x-ray beam.
Figure 1B:
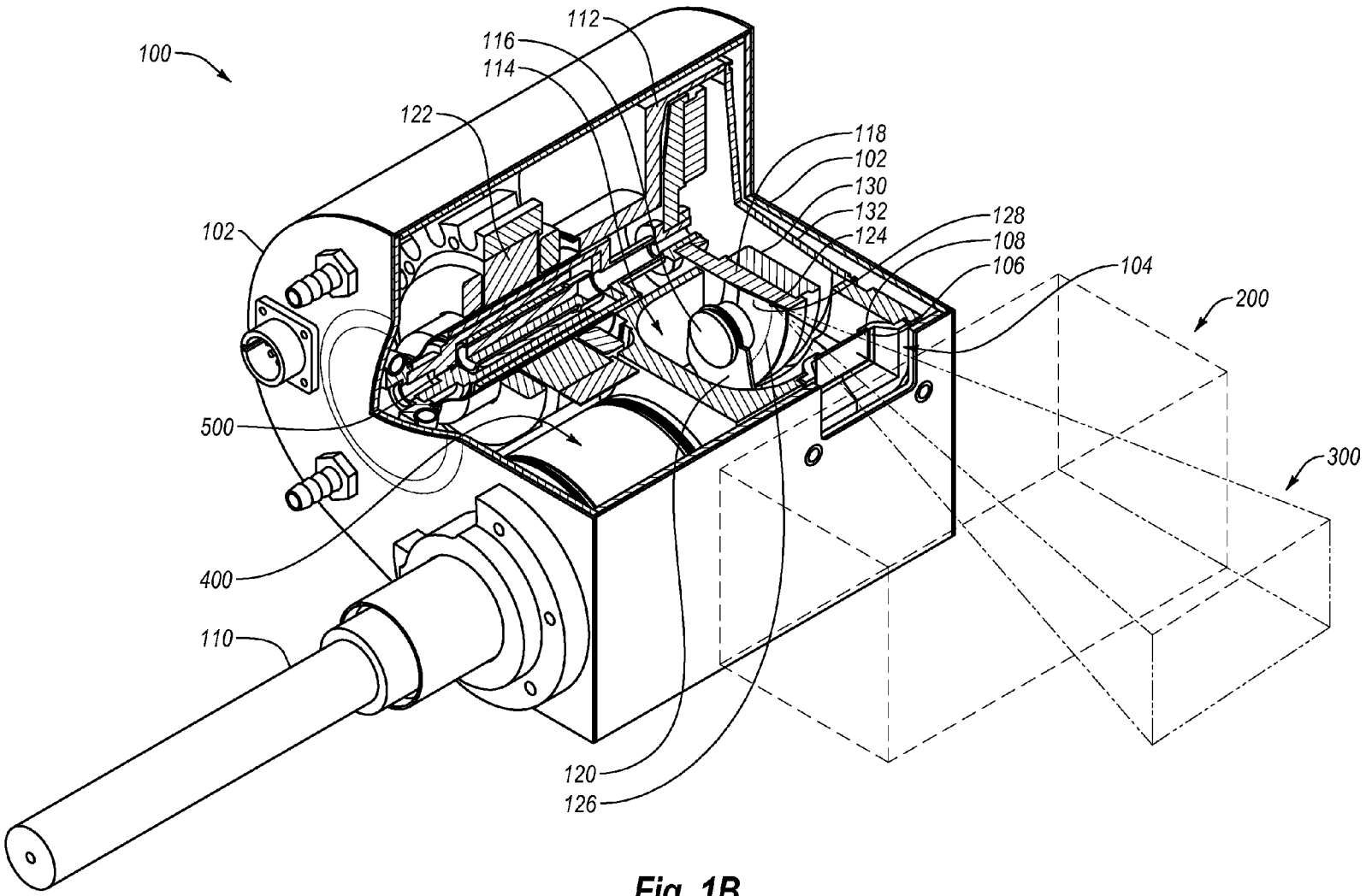
FIG. 1B is a perspective sectional view of the example x-ray tube, collimator, and x-ray beam of FIG. 1A.
Figure 1C:
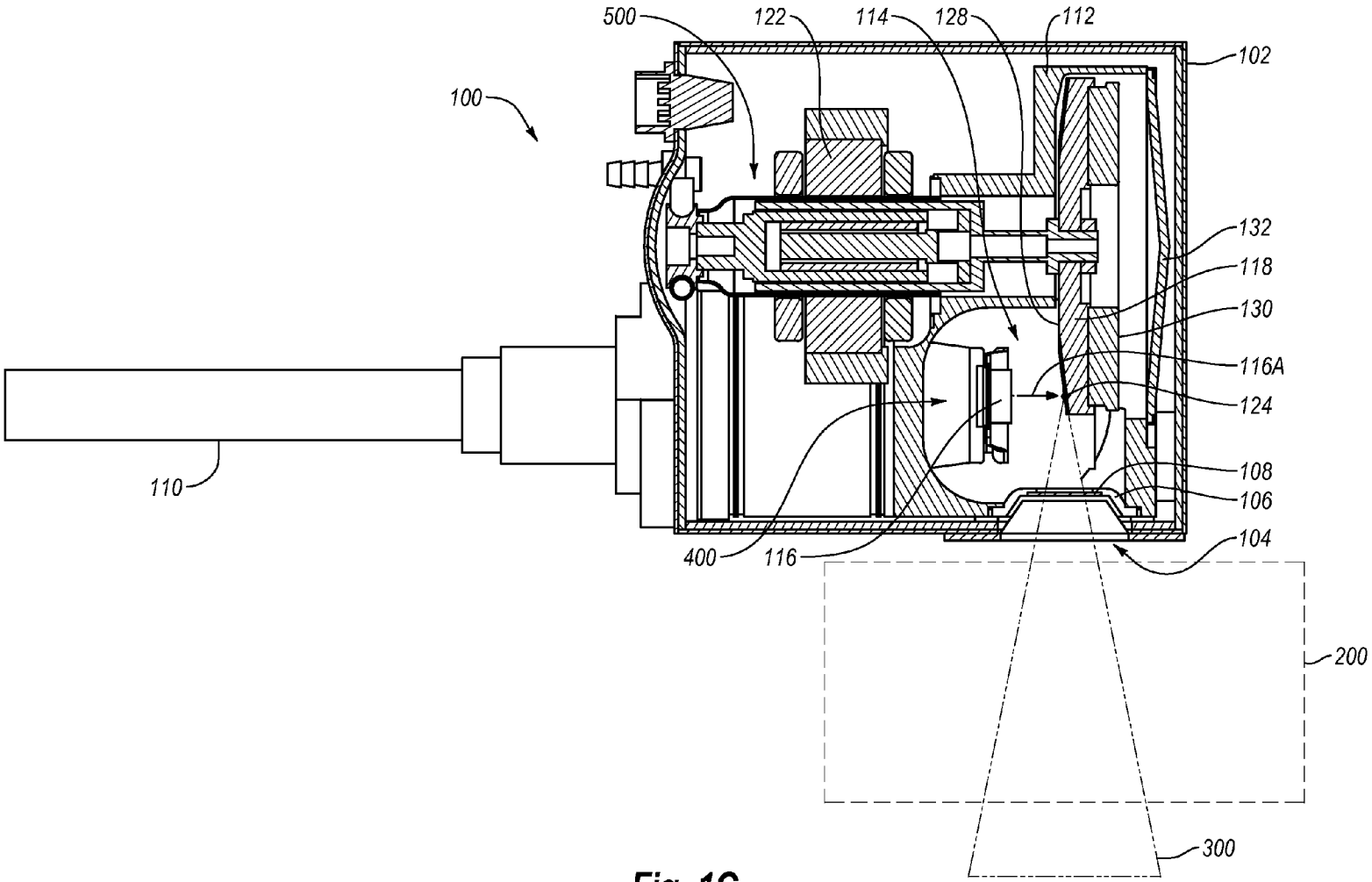
FIG. 1C is a sectional top view of the example x-ray tube of FIG. 1A.

With reference first to FIGS. 1A-1C, an example x-ray tube 100, an example collimator 200, and an example x-ray beam 300 are disclosed. The example x-ray tube 100 and collimator 200 are configured for use in C-arm applications, but it is understood that the asymmetrical aspects of the x-ray tube disclosed herein can be employed in x-ray tubes configured for use in other applications including, but not limited to, computed tomography (CT), diagnostic, or industrial.

As disclosed in FIG. 1A, the example x-ray tube 100 generally includes a cover 102 that defines an opening 104 positioned proximate a window frame 106 and a window 108. The window 108 is comprised of an x-ray transmissive material, such as beryllium or other suitable material(s). The x-ray tube 100 also includes a high-voltage cable 110 that functions to deliver power to the x-ray tube 100. The x-ray tube 100 produces the x-ray beam 300 that passes through the collimator 200. The collimator 200 functions to limit the size and shape of the x-ray beam 300.

As disclosed in FIGS. 1B and 1C, the x-ray tube 100 further includes an envelope 112 which at least partially defines an evacuated enclosure 114 within which a cathode 116 and a rotating anode 118 are positioned. More particularly, the cathode 116 is attached to an arm 120 that extends from a cathode assembly 400 into the envelope 112 and the rotating anode 118 extends from an anode assembly 500 into the envelope 112. Both the cathode assembly 400 and the anode assembly 500 are at least partially positioned within the evacuated enclosure 114. The rotating anode 118 is spaced apart from and oppositely disposed to the cathode 116, and may be at least partially composed of a thermally conductive material such as copper or a molybdenum alloy for example. The rotating anode 118 and cathode 116 are connected in an electrical circuit that allows for the application of a high voltage potential between the rotating anode 118 and the cathode 116. The cathode 116 includes a filament (not shown) that is electrically coupled to an appropriate power source (not shown). The rotating anode 118 is rotated by a stator 122.

As disclosed in FIG. 1C, prior to operation of the example x-ray tube 100, the evacuated enclosure 114 is evacuated to create a vacuum. Then, during operation of the example x-ray tube 100, an electrical current is passed through the filament of the cathode 116 to cause electrons 116*a*, to be emitted from the cathode 116 by thermionic emission. The application of a high voltage differential between the rotating anode 118 and the cathode 116 then causes the electrons 116*a* to accelerate from the cathode filament and toward a focal spot 124 of a rotating focal track 126 (see FIG. 1B) that is positioned on a first surface 128 of the rotating anode 118. The rotating focal track 126 may be composed for example of tungsten or other material(s) having a high atomic ("high Z") number. As the electrons 116*a* accelerate, they gain a substantial amount of kinetic energy, and upon striking the target material on the rotating focal track 126, some of this kinetic energy is converted into the x-ray beam 300.

The rotating focal track 126 is oriented so that emitted x-rays 300 are directed toward the window 108. As the window 108 is comprised of an x-ray transmissive material, the x-rays beam 300 emitted from the focal track 126 pass through the window 108 in order to strike an intended target (not shown) to produce an x-ray image (not shown). The window 108 therefore seals the vacuum of the evacuated enclosure 114 of the x-ray tube 100 from the atmospheric air pressure outside the x-ray tube 100 and yet enables the x-ray beam 300 generated by the rotating anode 118 to exit the x-ray tube 100. As disclosed in FIG. 1C, the window frame 106 is configured such that the window 108 is recessed toward the focal spot 124. This recessing of the window 108 may accommodate a corresponding protruding coupler (not shown) of the collimator 200.

It is understood that upon striking the target material on the rotating focal track 126, a significant amount of the kinetic energy of the electrons 116*a* is transferred to the rotating anode 118 as heat. This heat conducts through the rotating anode 118 to a second surface 130 that is opposite the first surface 128 and that faces toward a first end 132 of the evacuated enclosure 114. The positioning of the rotating anode 118 proximate the first end 132 of the evacuated enclosure 114 may enable heat radiated from the second surface 130 of the rotating anode 118 to be transferred to cooling fluid circulated through copper tubing (not shown) that is positioned between the first end 132 of the evacuated enclosure 114 and the cover 102. It is noted that no intervening structure is positioned between the second surface 130 of the rotating anode 118 and the first end 132 of the evacuated enclosure 114. It is also noted that the window 108 is positioned proximate the first end 132 of the evacuated enclosure 114.

2. Asymmetric X-Ray Tube Arrangement

With continued reference to FIGS. 1A-1C, aspects of an example asymmetric x-ray tube arrangement are disclosed. The example asymmetric x-ray tube arrangement of the cathode assembly 400 and the anode assembly 500 in the x-ray tube 100 enables the focal spot 124 of the rotating anode 118 to be positioned closer to the window 108 of the x-ray tube 100 than in typical symmetrical x-ray tubes in which the cathode assembly is symmetrical with the anode assembly. The example asymmetric x-ray tube 100 is also generally more compact, and can be positioned in a smaller space, than typical symmetrical x-ray tubes.

Figure 2A:
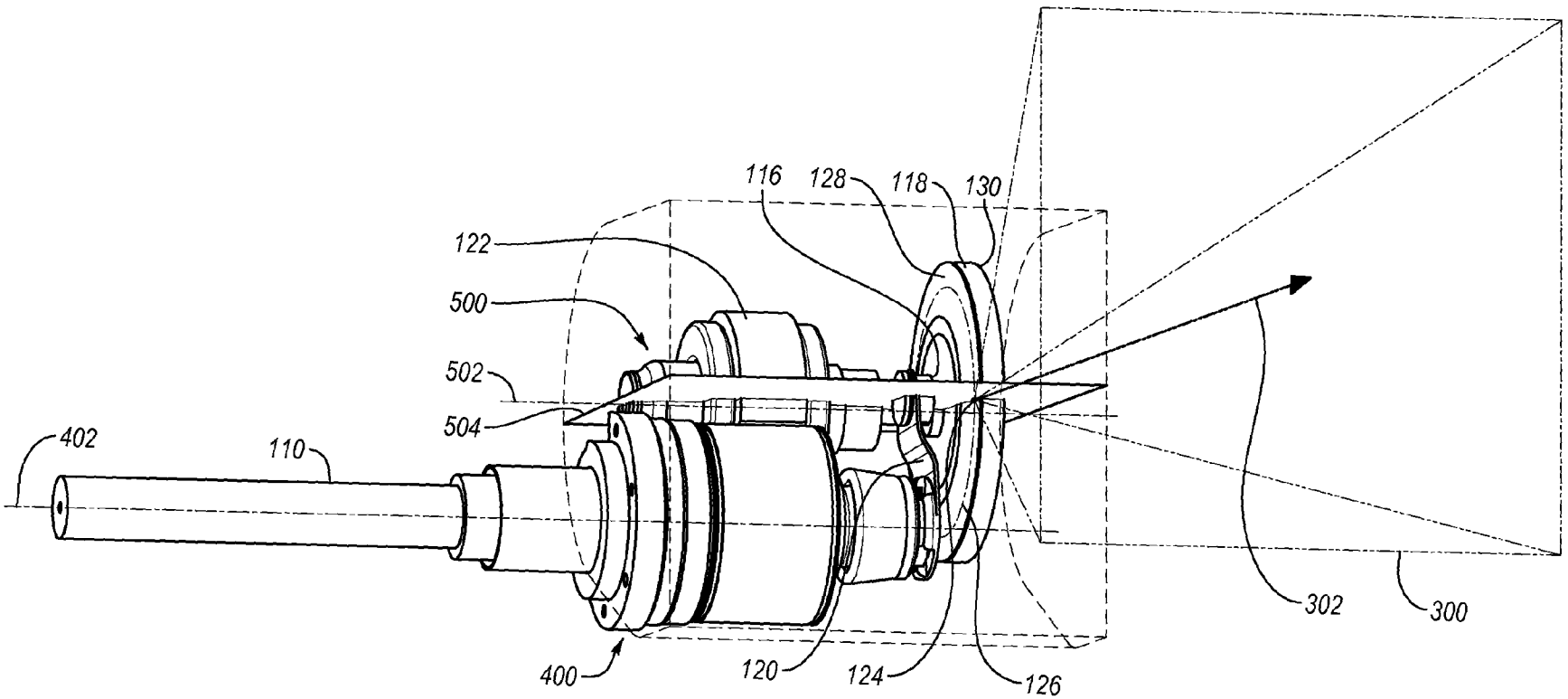
FIG. 2A is a perspective view of an example anode assembly, cathode assembly, and x-ray beam of the x-ray tube of FIG. 1A.
Figure 2B:
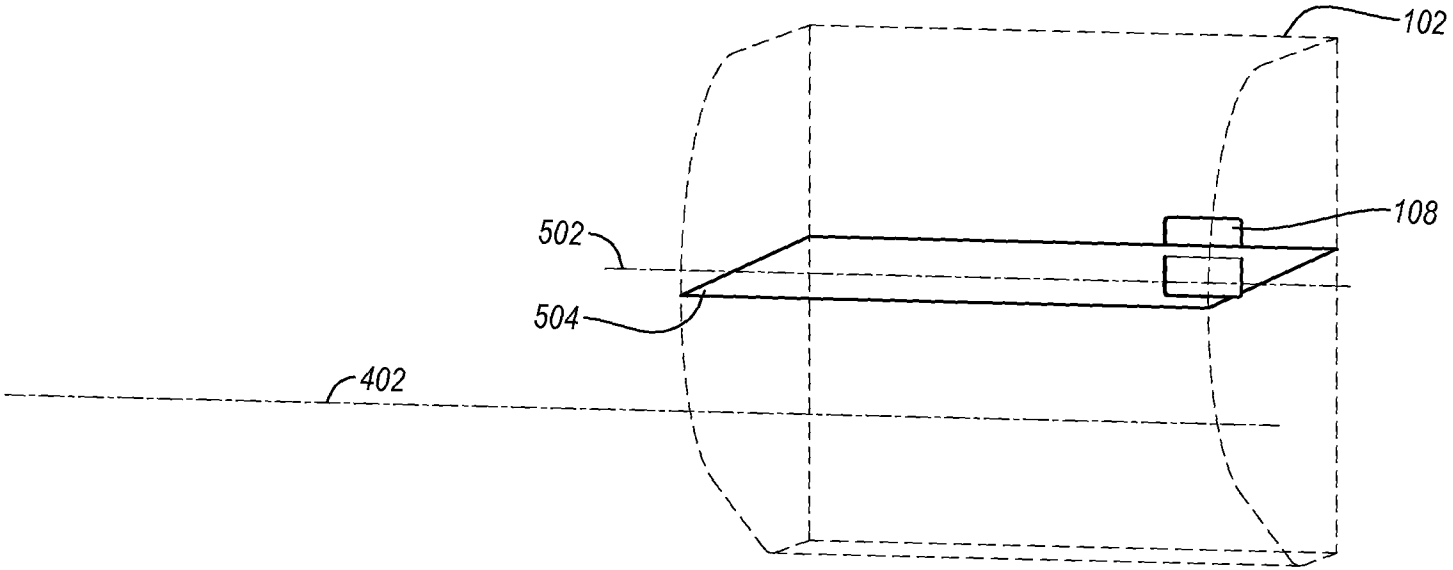
FIG. 2B is a perspective view of a plane defined by the anode assembly and an axis defined by the cathode assembly.

As disclosed in FIG. 2A, the cathode assembly 400 defines a first axis 402 within the x-ray tube 100 and the anode assembly 500 defines a second axis 502 within the x-ray tube 100. The focal spot 124 on the rotating focal track 126 of the rotating anode 118 and the second axis 502 define a plane 504 within the x-ray tube. As disclosed in FIGS. 2A and 2B, the first axis 402 within the x-ray tube 100 is positioned beneath the plane 504. Thus the cathode assembly 400 is asymmetrical with respect to the plane 504, making the x-ray tube 100 an asymmetrical x-ray tube. Also disclosed in FIGS. 2A and 2B, the first axis 402 may be parallel to the second axis 502. Further, as disclosed in FIG. 2A, the focal spot 124 may be configured to produce a central x-ray 302 in the x-ray beam 300 that emanates in the plane 504. Also, as disclosed in FIG. 2B, the window 108 may be positioned such that the window 108 is bisected by the plane 504 into two substantially equal parts.

As disclosed in FIG. 2A, the anode assembly is surrounded by a stator 122. Unlike typical x-ray tubes in which the focal spot of the target track faces away from the stator, the focal spot 124 of the rotating focal track 126 faces toward the stator 122. This arrangement of the focal spot 124 facing toward the stator 122 enables the relatively close and efficient placement of cooling channels near the rotating anode 118.

Also disclosed in FIG. 2A, the cathode 116 is attached to the arm 120 that extends from the cathode assembly 400 such that the cathode is not intersected by the first axis 402. The arm 120 may be substantially perpendicular to the first axis 402 and may also be substantially perpendicular to the plane 504.

The positioning of the cathode assembly 400 beneath the plane 504 defined by the anode assembly 500 and the focal spot 124 enables the focal spot 124 of the rotating anode 118 to be positioned closer to the window 108 of the x-ray tube 100 than in typical symmetrical x-ray tubes in which the cathode assembly is symmetrical in the plane defined by the anode assembly and the focal spot. This relatively closer positioning of the focal spot 124 to the window 108 enables the x-ray tube 100 to comply with certain proximity requirements of the collimator 200 (see FIGS. 1A-1C). In particular, the positioning of the cathode assembly 400 beneath the plane 504 defined by the anode assembly 500 and the focal spot 124 enables the focal spot 124 to be positioned about 80 millimeters from the closest surface of the collimator 200 (see FIGS. 1A-1C) as required by at least one example embodiment of the collimator 200. This distance is required by at least one example embodiment of the collimator 200 in order to ensure proper reshaping and resizing of the x-ray beam 300 by the collimator 200. The example asymmetric x-ray tube 100 is also generally more compact and thus can be positioned in a smaller space than typical symmetrical x-ray tubes.

The example embodiments disclosed herein may be embodied in other specific forms. The example embodiments disclosed herein are therefore to be considered in all respects only as illustrative and not restrictive.

What is claimed is:

1. An x-ray tube comprising:

an evacuated enclosure;

a cathode assembly at least partially positioned within the evacuated enclosure and defining a first axis, the cathode assembly including a cathode that extends from the cathode assembly via an arm structure and wherein the arm structure is completely disposed within the evacuated enclosure; and an anode assembly at least partially positioned within the evacuated enclosure and defining a second axis, the anode assembly including a rotating anode having a focal spot, the focal spot and the second axis defining a plane, the first axis positioned beneath the plane.

2. The x-ray tube as recited in claim 1, wherein the first axis and the second axis are substantially parallel to each other.

3. The x-ray tube as recited in claim 1, wherein the focal spot is configured to produce a central x-ray that emanates substantially in the plane.

4. The x-ray tube as recited in claim 1, wherein the evacuated enclosure includes a window that is substantially transmissive to x-rays and bisected by the plane.

5. The x-ray tube as recited in claim 4, wherein the window is bisected by the plane into two substantially equal parts.

6. The x-ray tube as recited in claim 4, wherein the window is recessed toward the focal spot.

7. An x-ray tube comprising:

an evacuated enclosure;

a cathode assembly at least partially positioned within the evacuated enclosure and defining a first axis, the cathode assembly including a cathode that extends from the cathode assembly via an arm structure such that the cathode is not intersected by the first axis and wherein the arm structure is completely disposed within the evacuated enclosure;

a stator; and an anode assembly at least partially positioned within the evacuated enclosure and defining a second axis, the anode assembly including a rotating anode having a focal spot, the anode assembly at least partially surrounded by the stator, the focal spot and the second axis defining a plane, the first axis positioned beneath the plane, the focal spot facing toward the stator.

8. The x-ray tube as recited in claim 7, wherein the first axis and the second axis are substantially parallel to each other.

9. The x-ray tube as recited in claim 7, wherein the focal spot is configured to produce a central x-ray that emanates substantially in the plane.

10. The x-ray tube as recited in claim 7, wherein the evacuated enclosure defines a window that is substantially transmissive to x-rays and bisected by the plane.

11. The x-ray tube as recited in claim 10, wherein the window is bisected by the plane into two substantially equal parts.

12. The x-ray tube as recited in claim 7, wherein the window is recessed toward the focal spot.

13. The x-ray tube as recited in claim 7, wherein the arm structure is substantially perpendicular to the first axis.

14. The x-ray tube as recited in claim 13, wherein the arm structure is further substantially perpendicular to the plane.

* * * * *